United States Patent [19]

Emblin

[11] Patent Number: 4,619,100

[45] Date of Patent: Oct. 28, 1986

[54] METHOD FOR FABRICATING A WATER IMPERVIOUS ROOF MEMBRANE

[76] Inventor: Robert T. Emblin, 5150 E. Paradise Dr., Scottsdale, Ariz. 85254

[21] Appl. No.: 608,349

[22] Filed: May 8, 1984

Related U.S. Application Data

[63] Continuation of Ser. No. 274,492, Jun. 17, 1981, abandoned.

[51] Int. Cl.[4] ..... E04D 1/00

[52] U.S. Cl. ..... 52/748; 52/90; 52/309.4; 52/409; 52/478

[58] Field of Search ..... 52/90, 94, 173 R, 278, 52/394, 395, 404, 472, 478, 747, 748, 417, 309.4, 309.8, 408–410

[56] References Cited

U.S. PATENT DOCUMENTS

| | | | |
|---|---|---|---|
| 2,060,093 | 11/1936 | Markel . | |
| 2,781,877 | 2/1957 | Ochiltree | 52/748 |
| 2,832,300 | 4/1958 | Jacobson . | |
| 2,974,078 | 3/1961 | Petritz | 52/441 |
| 3,332,186 | 7/1967 | Cammaert | 52/302 |
| 3,353,316 | 11/1967 | Berg | 52/464 |
| 4,063,395 | 12/1977 | Stewart et al. | 52/309.5 |
| 4,112,632 | 9/1978 | Simpson | 52/11 |

*Primary Examiner*—J. Karl Bell

*Attorney, Agent, or Firm*—Cahill, Sutton & Thomas

[57] ABSTRACT

A rectangular grid of support members is secured to a continuous load bearing roof deck. The interior of each grid section is filled with a layer of insulation extending from the roof deck to the top of the support members defining the grid. A plurality of flexible metal panels are positioned above each roof grid section to form overlapping joints between each of the panels. A strip of sealant is positioned within each of the overlapping joints. The overlapping joints are sequentially compressed. Compressive securing means are passed through each of the overlapping joints and secured to the upper surface of underlying support members at closely spaced apart intervals to interlock the adjacent panels and to form a compressed, water impervious seal along each of the overlapping joints.

22 Claims, 12 Drawing Figures

72
102
90
92
14
94
22
103
99
35
95
18
30
70
38
34
24
7
75
32
36

176
175
124
178
180
122
186
192
132
182
184
192
190
195
200
201
5
6
130
225
30
120
128
160
70
142
72
4
30
144
147
148
146

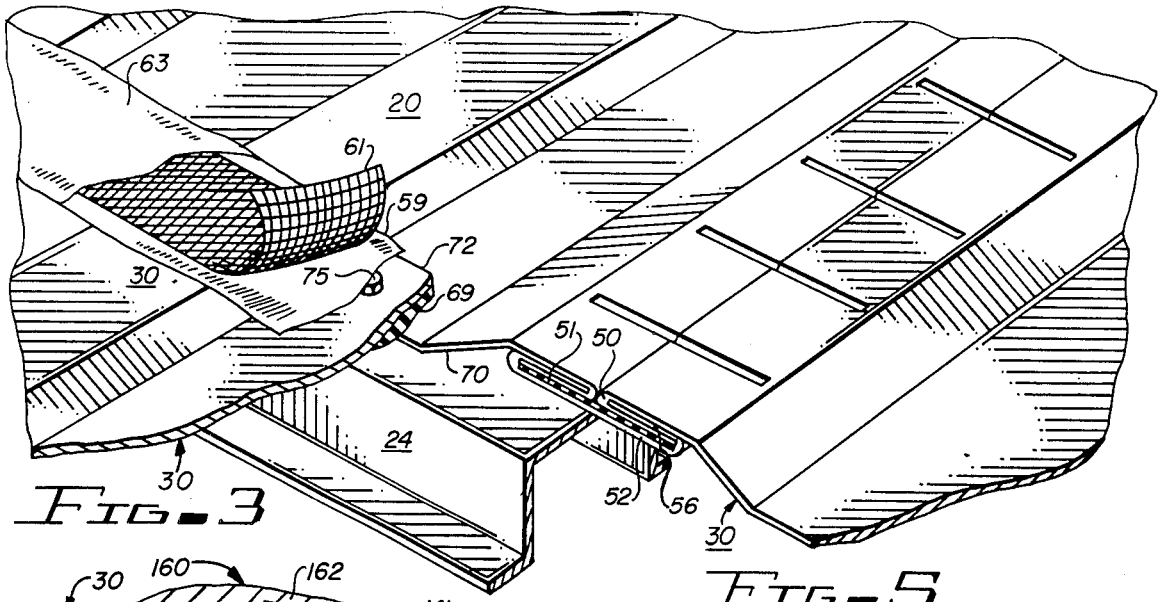
FIG. 3
FIG. 5
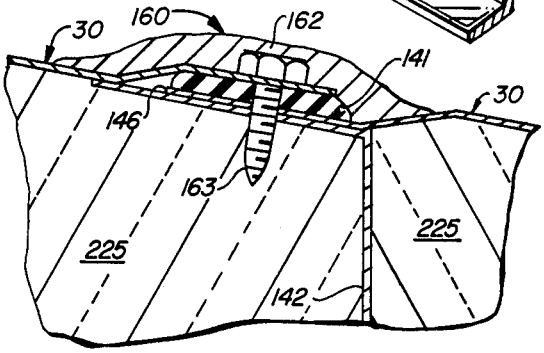
FIG. 4
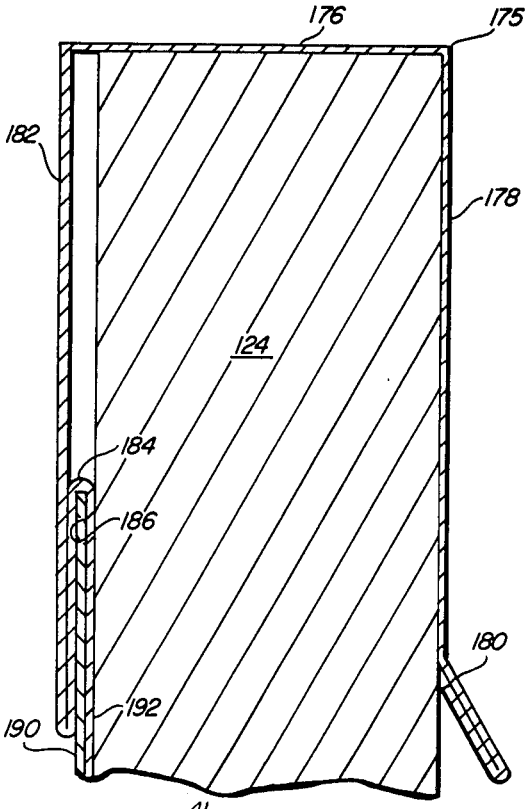
FIG. 6
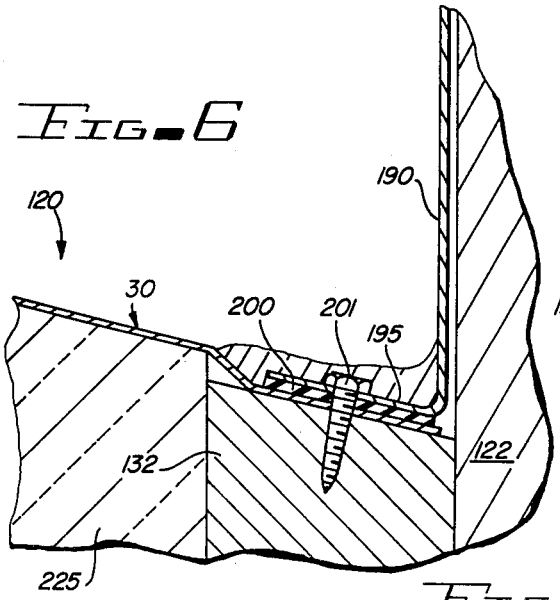
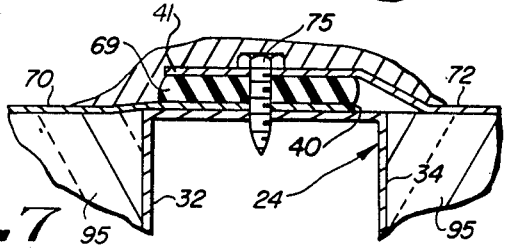
FIG. 7

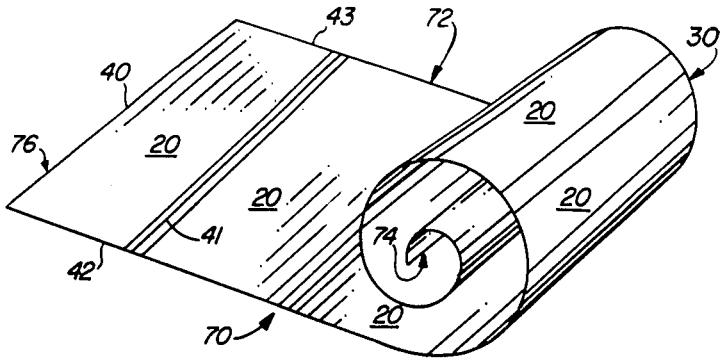
FIG-8
FIG-10
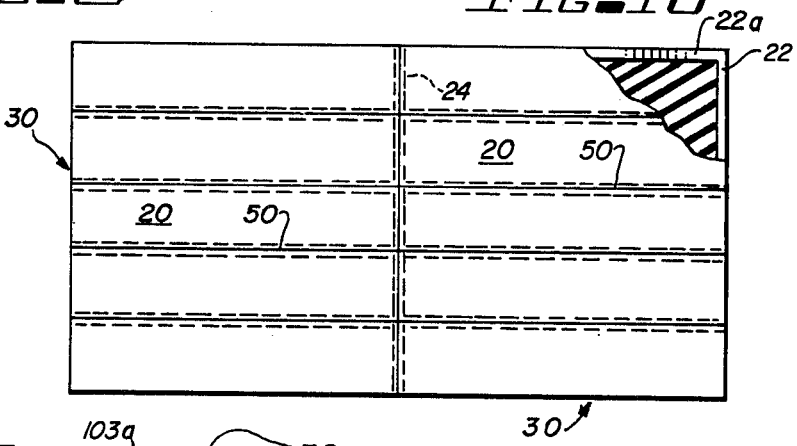
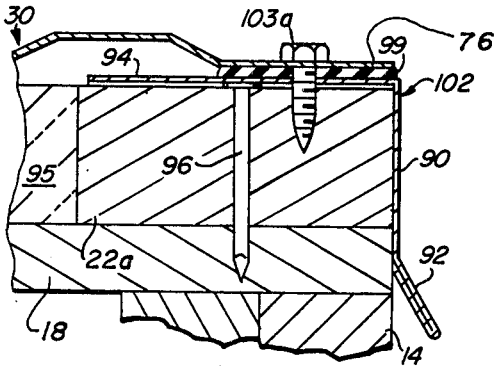
FIG-11
FIG-12
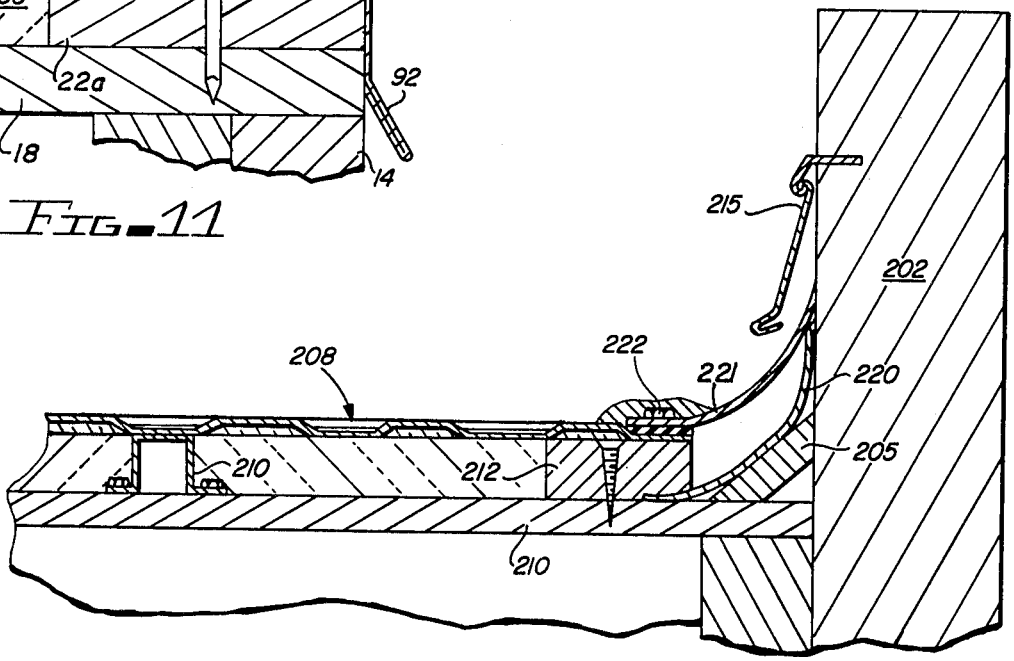

METHOD FOR FABRICATING A WATER IMPERVIOUS ROOF MEMBRANE

This application is a continuing application of U.S. patent application Ser. No. 274,492, filed 6/17/81 now abandoned, and entitled "PREFABRICATED STRUCTURAL ROOFING SYSTEM."

FIELD OF THE INVENTION

This invention relates to roofing systems and more particularly relates to prefabricated structural roof systems.

BACKGROUND OF THE INVENTION

Built-up roofing has been used for many years. Built-up roofing typically utilizes a deck of wood such as plywood supported on beams or rafters. The built-up system is constructed in place and the entire roof deck is covered by a continuous weather-proof membrane usually comprising alternate layers of felt and asphalt. The membrane is applied in a field operation. Once the membrane has been applied, gravel, rock or similar aggregate is spread upon the roof to give a resistance to wear resulting from weathering and foot traffic. Typically, thermal insulation is applied at the inner side of the decking to minimize heat transfer through the deck.

Built-up systems present substantial problems where extreme temperature ranges of heat and cold are encountered. Expansion and contraction, particularly of a metal building system, can create substantial problems resulting in failure along the perimeter of the building when thermal movement is encountered.

In view of the substantial disadvantages to conventional built-up roof systems, a number of prefabricated roofing systems have been developed in the prior art. Such prior art prefabricated systems require substantial on-site construction and often do not make adequate provision for sealing around obstructions such as roof-mounted equipment and parapets. Thus, leakage can result at these points as thermal movement of the roofing system occurs. Furthermore, watertight integrity of such roofing systems is difficult to achieve and has lead to various complicated and expensive systems using sealing membranes over the expense of the roof surface.

Accordingly, there exists a need for a prefabricated system which can be quickly and easily erected with minimum labor and skill, which is reliably moisture-tight, and which is compatible with various building sizes, shapes and constructions.

SUMMARY OF THE INVENTION

Briefly, the present invention discloses an improved preformed (or prefabricated) roof structure in which a series of rectangular sheet metal panels are joined along adjacent longitudinal edges at a sealed interlocking joint to form an elongate sheet metal skin. The sheet metal skin is secured in place on supports on the roof decking. Adjacent longitudinally extending sections of the skin are joined at an overlapping joint which is sealed by tape and secured by fasteners and further made moisture impervious by application of a suitable sealant. The present invention also contemplates as part of the system a parapet cap which includes an expansion joint which accommodates a skirt interposed between the roof skin and the parapet cap and suitable edge flashing. Suitable insulation is provided between the roof skin and decking.

DESCRIPTION OF THE DRAWINGS

Other objects of this invention will appear in the following description and claims, reference being made to the accompanying drawings forming a part of the specification wherein like reference characters designate corresponding parts in several views.

FIG. 3 is a detail perspective view of a portion of the roofing system;

FIG. 4 is an enlarged detail view of a portion of the roofing system as indicated in FIG. 2;

FIG. 5 is an enlarged detail view of a portion of the roofing system as indicated in FIG. 2;

FIG. 6 is an enlarged detail view of a portion of the roofing system as indicated in FIG. 2;

FIG. 7 is an enlarged detail view of a portion of the roofing system as indicated in FIG. 1;

FIG. 8 is a view illustrating a pre-formed coil of roofing skin;

FIG. 10 is a schematic plan view illustrating a typical layout of the roofing system of the present invention;

FIG. 11 is a detail view of an end edge flashing of the roofing system as shown in FIG. 1; and FIG. 12 is a cross-sectional view of the system applied by retrofit to an existing roof structure.

DETAILED DESCRIPTION

Figure 9:
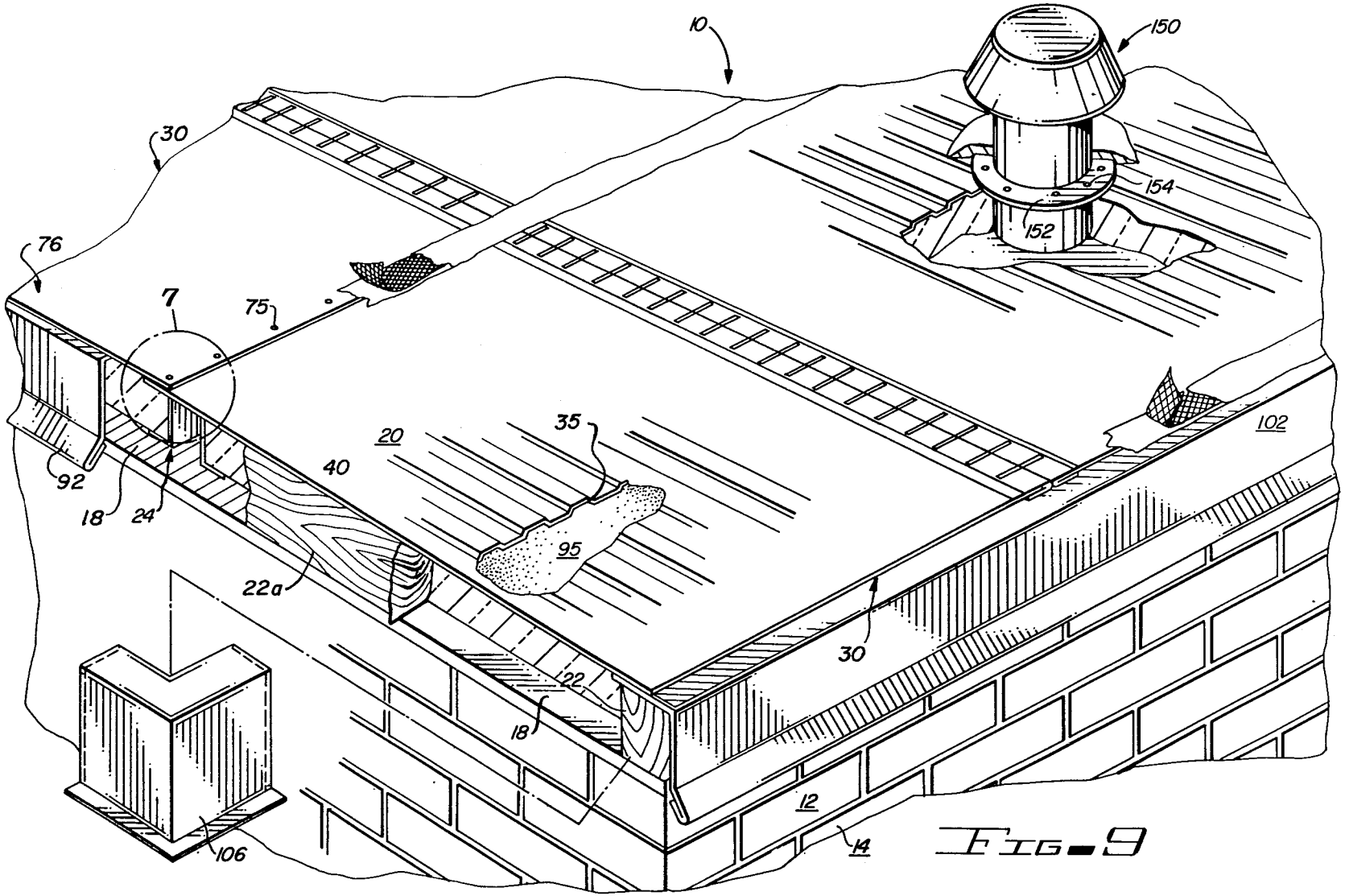
FIG. 9 is a perspective illustrating the roofing system of FIG. 2 as applied to a masonary building.

Referring now to the drawings, particularly FIG. 9, the roofing system, generally designated 10, is shown in conjunction with a building 12 which may be of any construction. A conventional block wall 14 supports transversely extending rafters (now shown) which support a load bearing plywood deck 18. Roof system 10 comprises a supporting frame structure including a plurality of elongated support members 22, **22*a* and 24 disposed on top of deck 18**.

Wood beam support members 22 and **22*a* are disposed along the peripheral edge and the purlin support members 24 are spaced in parallel relationship with respect to each other and extend upwardly a defined height from deck 18. As is evident in the drawings, purlin support members 24 are in parallel relationship to one edge of deck 18 along which edge wood beam support members 22 are disposed. Thus, the supporting frame structure includes a plurality of rectangular grid sections formed by elongated support members 22, 22*a* and 24. As best seen in FIG. 10, the rectangular grid sections have extended lengths measured in a first direction parallel to one edge of deck 18 and preselected widths measured in a second direction normal to the first direction of the extended lengths. Purlins 24 span across the entire deck 18 on building 12**.

Figures 1, 2:
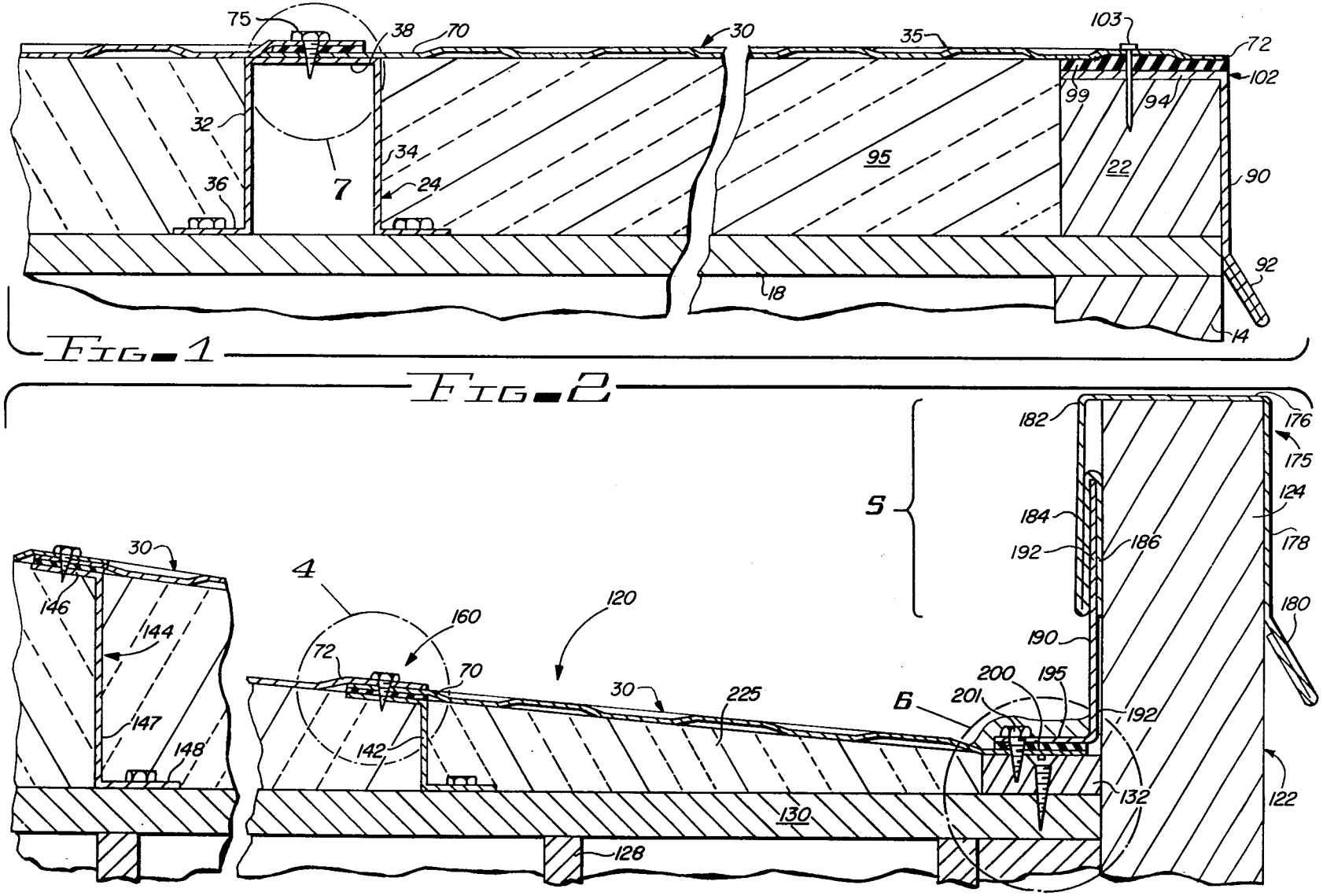
FIG. 1 is a cross-sectional view of a typical installation of the roofing system of the present invention.
FIG. 2 is a cross sectional view of an alternate installation.

As best seen in FIGS. 1, 7 and 9, each purlin 24 has a generally U-shaped cross sectional configuration with opposite vertically upstanding legs 32 and 34 and a flange 36 secured to deck 18. Horizontal web 38 extends between legs 32 and 34 and supports a lap seam along the length of purlin 24 where adjacent outer skin sections 30 overlap at their outer edges as shown in the drawings.

As shown, rigid blocks of polyurethane or polystyrene insulation 95 are placed within each of the grid sections defined by the intersection of the longitudinal and transverse support members 22, 22*a* and 24. Blocks 95 are supported below by the continuous, load bearing roof deck 18 and extend up to the upper surface of support members 22, 22*a*, and 24. Thus, there is a substantially continuous top surface over the top of the parallel elongated support members 22, 22*a* and 24 and insulation blocks or panels 95.

A plurality of prefabricated outer skin sections 30 are dimensioned to overlap the extended parallel supporting members 22 and 24 which define the extended predetermined lengths of each rectangular grid section of the supporting frame structure. Each outer skin section 30 is composed of a plurality of juxtaposed sheet metal panels 20. Each panel 20 has two opposed long length edges 40 and 41 and two opposed short width edges 42 and 43. Each pair of juxtaposed panels 20 are joined with a watertight seal at the adjacent long length edges 41 and 40 respectively.

The extended length of each outer skin section 30 is equal to the sum of all the short widths of the total number of juxtaposed sheet metal panels 20 joined together to form the outer skin section 30 as shown in FIG. 8. Thus, the outer edge 72 of section 30 is equal to the sum of all the short width edges 43 found on each one of the panels 20 and likewise, outer edge 70 is the sum of all of the short width edges 42 of the panels 20. The outer edges 76 and 74 of the skin section 30 are equal in length to the outer long width edges 40 and 41, respectively of the panels. That is, the length of the individually formed panels 20 which are subsequently joined together along their opposed edges actually form the width of the outer skin section 30 which are dimensioned to overlap the parallel support members 22 and 24 which define opposed sides of each grid section of the supporting frame structure. In this specific embodiment, the opposed long side edges 40 and 41 of panels 20 is approximately 12 feet long. Typically, the short width edges 42 and 43 are in the range of three to four feet wide. The extended lengths of opposing edges 70 and 72 of the outer skin section 30 is of sufficient length to extend from one end of a grid section to the other as shown in FIG. 10.

Each panel 20 used for prefabricating each outer skin section 30 is preformed from a continuous coil of sheet material such as 30-gauge galvinized or 0.24 inch aluminum sheet. Either the galvanized metal or the aluminum may be prepainted. Thus, in other words, each outer skin section 30 is composed of a plurality of prefabricated sheets 20 of material with the skin section 30 having a resultant flexibility of a material composed of a 30-gauge galvanized sheet metal or a sheet of aluminum having a thickness of 0.24 inch.

Each of the sheet metal panels 20 are cut from a continuous coil that is typically three to four feet wide. The coil of sheet material is extended and cut into the individual panels 20. In this specific embodiment, the individual panels 20 are run through a pattern machine to apply corrugations 35 which extend parallel to the opposed long length edges 40 and 41. Corrugation 35 serve to stiffen and strengthen the resulting skin section 30. At the same time, corrugations 35 serve to allow for expansion and contraction of the roof without placing unnecessary stress on the structure which might otherwise cause the roof to lift or cause the panels 20 to rear away from the supporting structure members 20, 22*a* and 24 which would thus cause damage to the integrity of the roof.

Stated another way, the outer skin sections 30 are freely disposed over the top surface of the insulation panels 95 without bonding thereto with the outer edges 70 and 72 of outer skin section 30 being registered with the parallel support members 22 and 24 to which said edges 70 and 72 are fixedly secured with mechanical fastener means 75. Thus, as stated above, the outer skin section 30 is allowed to freely expand and contract between the parallel support members 22 and 24 without placing unnecessary stress on the supporting structure 22, 22*a* and 24 thereby avoiding damage to any sealed watertight integrity located at the outer edges 70 and 72 of the outer skin section 30.

Returning to the manner in which outer skin sections 30 are constructed in this embodiment, the longitudinally opposed edges 40 and 41 of each individual, juxtaposed panel 20 are bent into a generally U-shaped bend 50. The bent or crimped edges 40 and 41 are joined together by cleats 52 as shown in FIG. 3. Each cleat 52 includes reversely bent lips 56 which are inserted between the crimped or bent edges 40 and 41 as shown in FIG. 3. A layer of sealant material 51 such as cleat cement sold by Elixir Industries of Gardenia, Calif., is inserted in the crimped junction. The joined edge structure is then compressed up to a 150 ton press pressure.

The prefabrication of the outer skin sections 30 is accomplished away from the construction site. The crimping, cleat joining and sealing operation is repeated and individual panels 20 are joined until the desired length of the outer skin section 30 is fabricated to a predetermined, convenient length for handling. The outer skin section 30 has a flexibility such that it may be rolled into a coil as shown in FIG. 8. The coiled skin section 30 is then transported to the job site where it is secured in place in accordance with the invention.

The above procedure converts a continuous roll of sheet material such as galvanized steel or aluminum into a full sized, water impervious or watertight roof skin section having any desired length and width. As is evident herein, the skin section 30 is composed of a single ply sheet metal as clearly evidenced in the drawings.

The joining of the pairs of juxtaposed panels 20 along their length edges 40 and 41 produces the generally rectangular, elongate outer skin section 30 having opposite side edges 70 and 72 and end edges 74 and 76 as shown in FIG. 8. When laid in place, side edge 72 laps over the side edge 70 of a juxtaposed outer skin section 30. A suitable sealant 69 such as "Mobile-lastic" commercially available from Elixir Industries of Gardenia, Calif., is placed between the panel edges 70 and 72 to create a primary sealed overlapping junction between adjacent outer skin roof sections 30.

Compressive sealing means or mechanical fasteners such as zinc-coated, self-tapping sheet metal screws 75 are secured at closely spaced apart intervals of, for example, 1¼ inch along the entire overlapping length of the skin edges as shown. The screws 75 penetrate the overlapping panel edges 70 and 72 and the upper web 38 of purlin support member 24. Thus, screws 75 secure the overlapping skin edges 70 and 72 together and the coupled panels directly to the support member 24. Furthermore, a compressive force is exerted between the overlapping panel edges 70 and 72 and the sealant 69.

To further insure the watertight integrity of the system, a secondary sealant layer is applied over the mechanical fastening screws 75 and the overlapping edges 70 and 72 of the adjacent skin sections 30. It is recommended that an area extending several inches from either side of the overlapping area be first brushed with a coat of a fibrous plastic sealant material 59 such as the commercially available "Plasticoat Sealant" produced by Elixir Industries. Membrane 61 is then applied over the sealant layer 59 and a second layer 63 of "Plasticoat Sealant" is then applied over membrane 61 as shown.

By applying this sealant means over the mechanical fastener means 75 and the overlapped joint, the joined, juxtaposed skin sections 30 have an exterior mastic which prevents penetration of moisture. The sealant means creates a seal having watertight integrity around the entire periphery of each grid section covered by the respective outer skin sections 30.

As is evident in the drawings, the outer skin sections 30 are freely disposed over the insulation panels 95 without bonding thereto. As discussed hereinabove, the only place where bonding and sealant materials are used are at the outer edges 70 and 72 of the skin sections 30 as they are disposed on the support members 22 and 24. The end edges 74 and 76 of the outer skin section 30 are fastened to the transverse support members **22*a* in a fashion discussed below regarding the outer edge of the panel as shown in FIG. 1**.

Referring to FIGS. 1, 9 and 11, the edges and sides of the building are provided with flashing to seal the system perimeter. To this end a flashing 102 is provided with a vertical edge section 90 having an angular flange 92 and a horizontal lip 94. The angular flange 92 is located and positioned along the vertical wall 14 of the building and overlaps the wall so that water is prevented from entering in the area 96 between the roof deck and the skin 30. Section 30 overlaps horizontal lip 94 of flashing 102 and sealant 99 is interposed therebetween. Mechanical fastener 103 extends into subjacent wood beams 22 to secure flashing 102 and outer edge 72 of skin section 30. Fastener 96 holds end edge beam **22*a* to deck 18 while fastener 103*a* holds end edge 76 of skin section 30 and flashing 102 in place as shown. Elbow flashing sections 106** are provided at the corners of the building and are secured in the manner described above.

The roofing system as described herein can be prefabricated with the individual outer skin sections 30 and the purlin support members 24 and the peripheral edge support members 22 and **22*a*** being fabricated at a location away from the building site. All of the various parts are manufactured in accordance with the building requirements which are established initially through careful inspection and planning. The roofing system of the present invention is compatible with a large number of different wall structures and different building configurations. The totally new system maintains an attractive and aesthetically pleasing appearance while allowing expansion and contraction but also withstanding wind uplift and maintaining watertight integrity.

The roofing system of this invention can be configured to create a pitched roof as shown in FIG. 2 rather than the substantially flat roof which has been described hereinabove. The roofing system, generally designated 120, is connected to an upstanding vertical wall 122 terminating at parapet 124.

Rafters 128 support a wooden deck 130. An interior ceiling (not shown) of wallboard or other finishing panel materials are applied at the underside of rafters 128. A wooden perimeter piece 132 extends around the edge of roof deck 130. The outer metal skin section 30 is performed in accordance with the procedure described above. Rigid insulation panels 225 are disposed between the support members 132 and 142 and between purlin support members 142 and 144. Purlin support members 142 and 144 are generally Z-shaped in cross section having a vertical channel member 147 and oppositely extending flanges 146 and 148.

Upper flange 146 is slightly angled to accommodate the roof pitch. The height of purlin members 142 and 144 is selected to give an appropriate pitch to the roof. The outer skin section 30 is freely disposed over the top surface of the rigid insulation panel 225 without bonding thereto as shown in the drawings. The outer edges 70 and 72 of adjacent skin sections 30 overlap on the top of the upper flanges 146 of purlin support members 142 and 144 as shown.

The overlapping joint, generally designated 160, includes adjacent outer skin section 30 sealed by fastener 163 with a joint sealant 141 disposed between the outer edges of said skin sections 30. A secondary sealant layer 162 is applied over the fastener 163 and the outer edges and sealant 141 as shown in FIG. 4. With an inclined roofing system as shown in FIG. 2, it is desirable that the upper skin section 30 be lapped above and over the next lower skin section 30.

As seen in FIGS. 2 and 5, cap 175 is provided on parapet 124. Cap 175 includes a generally horizontal top hanger member 176 and a vertical leg 178 terminating at angular flange 180 on the front side of the parapet. At the rear side of the parapet, depending leg 182 is bent at 184 to form a vertical slot 186. An angular skirt member 190 has a vertical section 192 and a base flashing portion 195 which overlays the outer edge of section 30. The vertical leg section 192 extends into slot 186 and is freely moveable therein. Base flashing is secured to the edge of roof section 130 by an interposed layer of mastic 200 and by mechanical fasteners 201 extending through flashing 195 at the edge of panel 130 into wooden perimeter piece 132. A secondary sealant layer may be added as desired.

Expansion and contraction of the parapet cap relative to the skirt is accommodated within slot 186. Angular lip 180 prevents entry of moisture beneath the parapet cap.

Insulation 225 is applied between roof deck 130 and outer skin section 30 and may be pre-cut in sections consistent with the roof pitch.

As depicted in FIG. 9, any roof mounted equipment such as ventilator 150 may be sealed to skin section 30 by securing the peripheral flashing 152 to skin section 30 with fasteners 154. The area along the edge of the flashing is coated with "Plasticoat Sealant" and Fiberglass as described above.

FIG. 12 illustrates the system of the present invention retrofit to an existing roof structure having a deck 210 extending to parapet 202 with cant section 205 angularly disposed between the deck and parapet. The new roof membrane is formed from panel sections 208, purlins 210, and wooden perimeter support members 212.

To accommodate existing parapet flashing 215, arcuate cant flashing 220 and arcuate parapet flashing 221 are secured between the roof and parapet 202, as shown. The upper, arcuate parapet flashing 221 is secured to the edge support member 212 via mechanical fasteners 222 and a layer of sealant is applied at the lower edge thereof as shown. "Plasticoat Sealant" and a Fiberglass membrane may be applied along the upper surface of the joint. The upper end of parapet flashing 221 terminates below the lip of the existing flashing 215. The arcuate cant flashing 220 is supported thereunder by the diagonally disposed support member 205.

The water impervious roof membrane of the present invention may be fabricated by performing the following steps:

1. The surface of deck 18 should be cleaned and all debris removed.
2. Air conditioning ducts, evaporative cooling units and similar units, must be removed, or set on pedestal so a flashing can be installed properly.
3. All vents, caps or other obstructions 150 must be removed.
4. Once the roof surface is prepared, a grid plan as seen in FIG. 10, is used to lay out the placement of the support members 24 which extend longitudinally and may also extend transversely at the midpoint or where adjacent sections 30 overlap.
5. Following the grid plan, supports 24 are secured to roof deck 18. Different fasteners will be required to secure support members 24 to wooden, metal or concrete roof decks.
6. After support members 24 have been secured to the roof deck, pre-cut sheets of polystyrene or other insulation 95 are placed in the grid sections defined by the support members. If the roof deck has proper pitch ($\frac{1}{4}''$ per foot), a single thickness of insulation may be used. If installed properly, the insulation should be level with the top of the supports 24.
7. Once the insulation panels 95 are in place, the coiled outer skin section 30 is unrolled over a grid section without any bonding being placed between the top surface of the insulation 95 and lower surface of the skin section 30 as shown. Thus, outer skin section 30 is freely disposed over insulation 95 with the outer edges 70 and 72 being registered in alignment with the centers of adjacent support members 22 and 24. Thus, each outer skin section 30 with its parallel outer edges 70 and 72, is dimensioned to overlap the parallel support members 22 and 24 disposed on either side of the rigid insulation. Obviously, the support member 22 is along one peripheral edge of the roof deck 18 while a plurality of support members 24 may be laterally spaced across the roofing deck away from the peripheral edge. The first outer skin section 30 attached to the edge support member 22 is placed first for proper drainage. As discussed above, fasteners 103 attach the outer edge 72 to the wood edge beam 22. Fasteners 75 attach the overlapping panels at purlin 24 as shown.
8. Sealant layer or tape 69 is applied to the upper perimeter of the first row of roof skin sections 30. The second row of roof sections 30 are unrolled and aligned with the underlying support members 24 and exposed sealant layer 69. After each row of roof sections 30 have been positioned, wood planks are placed about the overlapping upper roof sections 30 as close to the sealant layer 69 as possible to compress the corrugated edge sections 70 and 72 and thereby flatten the metal against sealant layer 69 and support members 24.

The overlapping joints between adjacent rows of roof sections 30 are then secured to each other and to support members 24 by a plurality of closely spaced drive screws 75. For the type of drive screws 75 illustrated in the drawings, the screw to screw spacing should be about $1\frac{1}{4}$ inch for a proper seal. After the second row of roof sections 30 has been installed as described above, the third and subsequent rows may be secured to support members 24 in the same manner. A particular roof section may have to be trimmed to accept roof vents, air units and other vertical obstructions. Before placing a roof skin section 30 on a grid section including a vertical obstruction, a measurement is taken and the area to overlie the obstruction is cut out. Then the roof skin section can be moved into place and screwed down. As is evident herein, the outer skin section forms a single layer of sheet material fastened securely only to the supporting frame structure and is free of any additional weight on the top thereof.

9. The roof flashing is applied next using the joint sealing techniques described above. The area to be flashed is lined and taped, the flashing is set in place and screwed down through the metal flashing tape into the support. Initially the screws are secured to the flashing at $1\frac{1}{2}$ to 2 foot intervals. The flashing must be maintained flat. Bunching should be avoided. Thereafter, the flashing is secured at closer intervals with approximately $1\frac{1}{4}''$ screw to screw spacing. Ideally, the effective screw spacing should not exceed $1\frac{1}{2}''$. Vent caps are applied in the same manner. Surface vents are applied at predetermined intervals for condensation. If there is no parapet, a perimeter flashing is applied as the first step in applying the total roof system.
10. After the flashing has been secured, the roof surface should be cleaned of debris, tools, etc. An inspection at this time is required, checking all lap seams, flashing secure points and vents to verify that all screws are tight and that sealant 69 is visible at every panel seam. Normal walking on the roof surface will not damage the roof membrane.
11. The fibrous roof coating is next applied to the lap means and to the flashing edges. This plastic secondary coating can be applied with a brush or a roller in 10" wide strips with $\frac{1}{4}''$ application depth. A fiberglass membrane is unrolled onto the roof coating and brushed into the sealant. A second $\frac{1}{4}''$ layer of sealant is then applied over the membrane. Once this operation is completed, the roof surface should be given a final inspection.

The significant advantages of the roof system of the present invention are forcefully demonstrated by its numerous advantages over existing systems. The weight per square foot of built-up roofing systems ranges from approximately 3 to 7 times that of the present system. The thermal resistance (R-value) of the present roof is substantially more than that of a built-up roof. The roof panels can be prepainted with a heat reflective coating to further improve the heat insulating properties of the system.

An important aspect of the present invention is that a major part of the fabrication can be accomplished at the factory. The roof panels and the supporting purlins can be precut to the desired length before being transported to the jobsite. The panel system has superior weathering properties and wind uplift and water resistance, but is light weight and can be quickly erected with minimum labor and skill. The system can be adapted to buildings of almost any size, shape and construction method. The system can be applied to new construction or can be retrofit to existing buildings. Once the system is installed, it requires virtually no maintenance.

It will be obvious to those skilled in the art to make various changes, alterations and modifications to the roofing system of the present invention. To the extent these changes, alterations and modifications do not depart from the spirit and scope of the appended claims, they are intended to be encompassed therein.

I claim:

1. The method of installing a roofing system on a load bearing deck, said method comprising the steps of:

(a) securing a supporting frame structure including a plurality of elongated support members on top of the deck;

(b) a portion of the support members extending across the deck in laterally spaced, parallel relationship with respect to each other and extending upwardly from the deck by a defined height;

(c) installing rigid panels of insulation between the parallel support members up to said defined height to provide a substantially continuous top surface over the top of the parallel elongated support members and the insulation disposed therebetween;

(d) providing an outer skin section having parallel outer edges and dimensioned to overlap the parallel support members disposed on either side of the rigid insulation;

(e) freely disposing the outer skin section over the top surface of the insulation without bonding thereto with the outer edges of the outer skin section being registered with said parallel support members;

(f) fixedly securing the outer edges of the outer skin section to said parallel support members with mechanical fastener means;

(g) applying sealant means over the mechanical fastener means and outer edges of the skin section to produce a seal having watertight integrity along the securely fixed parallel outer edges on top of said parallel support members;

(h) whereby the outer skin section is allowed to freely expand and contract between said parallel support members without placing unnecessary stress on the supporting structure, thereby avoiding damage to the sealed, watertight integrity at the outer edges of the outer skin section.

2. The method as defined in claim 1 wherein the outer skin section is composed of a prefabricated sheet of material with the skin section having a resultant flexibility of a sheet composed of 30-gauge galvanized sheet metal or 0.24 inch aluminum sheet.

3. The method as defined in claim 2 wherein the outer skin providing step includes prefabricating each outer skin section from a plurality of identical rectangular metal panels joined together in a side-to-side relationship by water impervious joints.

4. The method as defined in claim 3 wherein each of the rectangular metal strips includes a length substantially greater than its width.

5. The method as defined in claim 1 wherein said outer skin section providing step includes forming corrugations across the width of the outer skin sections to extend between the parallel outer edges thereof.

6. The method as defined in claim 1 wherein the outer skin section providing step includes preforming said outer skin sections from a plurality of individual metal panels having opposite end and side edges, said preforming step including joining said panels at adjacent side edges with a cleat joint to form a predetermined length of said outer skin sections, said outer skin sections being formed from a sheet material capable of being coiled into rolls at a location away from the job site for delivery to the job site.

7. The method of installing a roofing system on a load bearing deck having a peripherial edge, said method comprising the steps of:

(a) securing a supporting frame structure directly on the deck;

(b) said supporting frame structure defining a plurality of rectangular grid sections having extended predetermined lengths measured in a first direction parallel to one edge of the deck and having preselected widths measured in a second direction normal to said first direction of said extended lengths;

(c) said supporting structure including parallel, elongated support members forming the profile of said grid sections and extending upwardly from the deck by a defined height;

(d) installing rigid panels of insulation between the parallel support members up to said defined height to provide a substantially continuous top surface over the entire deck;

(e) providing a plurality of outer skin sections dimensioned to overlap the parallel support members which define opposed sides of each grid section of the supporting frame structure;

(f) freely disposing the outer skin section over the insulation without bonding thereto with the outer edges of the outer skin section being registered with the support members on opposite sides of the grid section;

(g) fixedly securing the outer edges of the outer skin section to the support members of each rectangular grid section with mechanical fastener means;

(h) applying sealant means over the mechanical fastener means to produce a seal having watertight integrity around the periphery of each grid section;

(i) whereby the outer skin sections are allowed to freely expand and contract between the parallel support members to which the outer edges of the outer skin section is secured without placing unnecessary stress on the supporting structure thereby avoiding damage to the sealed, watertight integrity of the roofing system.

8. The method as defined in claim 7 wherein each roof outer skin section is prefabricated and dimensiond to fit each grid section before the outer skin section is delivered to a job site.

9. The method as defined in claim 7 wherein the outer skin sections are rolled in coils and delivered to the job site.

10. The method as defined in claim 9 wherein the outer skin section providing step includes forming corrugations in the sheet material with the corrugations being oriented in a direction parallel to the central axis of the coils being rolled.

11. The method as defined in claim 7 wherein the outer skin section disposing step includes providing surface vents in the outer skin to vent the area between the outer skin section and the top of the insulation material.

12. The method as defined in claim 7 wherein the outer edge securing step includes applying an edge flashing at the peripheral edge of the roofing system being formed on the load bearing deck.

13. The method as defined in claim 7 wherein the outer skin sections placed on adjacent grid sections have overlapped outer edges to form an overlap joint along the parallel extending support members, said sealant means applying step including applying sealant means between the overlapped outer edges of the adjacent outer skin section.

14. The method as defined in claim 13 wherein the sealing of the overlapped joint includes placing a straight edge on the overlying roof outer skin section in proximity to the overlapping joint.

15. The method as defined in claim 7 wherein the outer edge securing step includes penetrating the overlapping joints with the mechanical fastener means at intervals of no more than 1½ inches apart.

16. The method as defined in claim 7 wherein the outer skin section providing step includes forming corrugations across the width of said outer skin section, providing a continuous water drainage gradient on a slightly inclined, flat roof load bearing deck with the corrugation of the outer skin sections being oriented parallel to the downhill roof gradient.

17. The method as defined in claim 16 wherein the edge of the uphill roof outer skin section forming an overlapping joint with the edge of an adjacent downhill roof outer skin section is positioned above the downhill roof outer skin section to provide a low resistance water drainage path along the downhill roof gradient.

18. The method as defined in claim 7 wherein the sealant means applying step includes sealing the roofing system along the peripheral edge of the deck by providing a flashing surface having a first edge sealed to the outer perimeter of said outer skin section and a second edge sealed to a watertight surface lying outside the roof skin section perimeter.

19. The method as defined in claim 7 wherein the sealant means applying step includes coating over the mechanical fastener means and the overlapped joint with a coating consisting of a membrane and alternate layers of a fibrous roof coating.

20. The method of installing a roofing system on a load bearing deck wherein a supporting frame structure is disposed directly on the deck and an outer skin layer is fastened securely only to the supporting frame structure and is free of any additional weight on the top thereof, said method comprising the steps of:

(a) placing a plurality of elongated support members directly on top of the load bearing deck to form said supporting frame structure;

(b) one portion of the elongated support members being disposed along the peripheral edge of the load bearing deck and another portion of the elongated support members being laterally spaced across the deck and disposed in parallel relationship with respect to one edge of the deck and with respect to each other;

(c) the elongated support members of said other portion extending in length along the entire deck being covered transversely to the elongated support members located at opposed peripheral edges of the load bearing deck;

(d) thereby providing said supporting frame structure including a plurality of rectangular grid sections having extended predetermined lengths measured in a first direction parallel to said one edge of the deck and having preselected widths measured in a second direction normal to said first direction of said extended lengths;

(e) said support members extending upwardly from the load bearing deck by a defined height;

(f) installing rigid panels of insulation between the parallel support members up to said defined height to provide a substantially continuous top surface over the entire deck;

(g) providing a plurality of prefabricated outer skin sections dimensioned to overlap said extended parallel support members defining the extended predetermined lengths of each rectangular grid section of the supporting frame structures;

(h) each said outer skin section being composed of a plurality of juxtaposed sheet metal panels with each panel having two opposed short width edges and two opposed long length edges with each pair of juxtaposed panels being jointed with a watertight seal at the adjacent long length edges thereof;

(i) the extended length of each outer skin section being equal to the sum of all the short widths of the total number of juxtaposed sheet metal panels joined together to form said outer skin section;

(j) freely disposing the outer skin sections over the insulation without bonding thereto with the outer edges of the outer skin sections being registered with the support members on opposite sides of the grid section;

(k) the outer skin sections placed on adjacent grid sections have overlapped outer edges to form an overlapped joint along the parallel extending support member;

(l) applying sealant means between the overlapped outer edges of the adjacent outer skin sections;

(m) securing said sections to the support member with mechanical fastener means; and (n) applying a sealant means over the mechanical fastener means and the overlapped joint;

(o) whereby the outer skin sections are allowed to freely expand and contract between the parallel support members to which the outer edges of the outer skin sections are secured without placing unnecessary stress on the supporting structure.

21. The method as defined in claim 20 wherein the outer skin sections are formed from a metal sheet material which is capable of being rolled into a coil for delivery to the installation site.

22. The method as defined in claim 21 wherein the outer skin providing step includes forming corrugations in said outer skin to extend in a direction parallel to the central axis of a coil.

* * * * *